US005921758A

United States Patent [19]

Anamoto et al.

[11] Patent Number: 5,921,758

[45] Date of Patent: Jul. 13, 1999

[54] ENGINE LUBRICANT SUPPLY SYSTEM

[75] Inventors: Takayuki Anamoto; Takayuki Murai, both of Iwata, Japan

[73] Assignee: Yamaha Hatsudoki Kabushiki Kaisha, Iwata, Japan

[21] Appl. No.: 08/932,663

[22] Filed: Sep. 18, 1997

[30] Foreign Application Priority Data

Sep. 18, 1996 [JP] Japan ..... 8-245926

[51] Int. Cl.[6] ..... F04B 17/04

[52] U.S. Cl. ..... 417/416; 417/32; 123/196 R

[58] Field of Search ..... 123/196 R, 73 AD; 417/32, 34, 416, 417; 184/6.4, 6.5, 7.4

[56] References Cited

U.S. PATENT DOCUMENTS

| | | | |
|---|---|---|---|
| 3,502,026 | 3/1970 | Toyoda | 417/32 |
| 4,272,225 | 6/1981 | Fujinaka et al. | 417/417 |
| 4,480,602 | 11/1984 | Kobayashi et al. | 123/73 AD |
| 4,725,208 | 2/1988 | Brown | 417/417 |
| 5,158,436 | 10/1992 | Jensen et al. | 417/32 |
| 5,287,833 | 2/1994 | Yashiro | 184/7.4 |
| 5,390,635 | 2/1995 | Kidera et al. | 123/196 R |
| 5,509,792 | 4/1996 | Sullivan et al. | 417/417 |
| 5,511,524 | 4/1996 | Kidera et al. | 123/73 AD |
| 5,597,051 | 1/1997 | Moriya et al. | 123/73 AD |
| 5,630,383 | 5/1997 | Kidera et al. | 123/73 AD |

FOREIGN PATENT DOCUMENTS

| | | | |
|---|---|---|---|
| 2606073 | 5/1988 | France . | |
| 163458 | 6/1989 | Japan | 417/417 |
| WO 95 26461 | 10/1995 | WIPO . | |
| WO 95 26462 | 10/1995 | WIPO . | |

*Primary Examiner*—Noah P. Kamen
*Attorney, Agent, or Firm*—Knobbe, Martens, Olson & Bear LLP

[57] ABSTRACT

A lubricant supply system for an engine provides lubricant from a supply to at least one portion of the engine. The system includes a lubricant pump and a pump control. The pump comprises a housing in which a solenoid operated pumping element and a portion of the pump control are positioned.

11 Claims, 7 Drawing Sheets

ENGINE LUBRICANT SUPPLY SYSTEM

FIELD OF THE INVENTION

The present invention relates to a lubricant supply system for an internal combustion engine and more particularly to such a system including a lubricant supply pump and a pump control.

BACKGROUND OF THE INVENTION

As is well known, engines require lubricant for their effective operation. With four cycle internal combustion engines, the lubricant is normally supplied to the engine through a recirculating lubricating system wherein the oil is not spent during the operation of the engine. With two cycle engines, on the other hand, the oil is delivered to the engine and is consumed through its lubricating or burned during combustion and any surplus is discharged through the exhaust along with that which has burned. Thus, it is very important to ensure that the amount of lubricant supplied to a two-cycle engine is very accurately controlled so as to minimize the amount of unused oil that will be discharged to the atmosphere through the exhaust.

For that reason, it has been proposed to dispense with or eliminate the previous type of lubricating systems utilized commonly with two-cycle engines wherein the lubricant was mixed with the fuel. In addition to not being as responsive to actual incremental engine running conditions, this mixing of lubricant with the fuel does not always assure that each component of the engine receives proper amounts of lubricant.

There have been proposed, therefore, a number of lubricating systems wherein lubricant is delivered directly to the components of the engine through a delivery system that can be controlled on a cycle-to-cycle basis. These systems generally use reciprocating type pumps that are operated through one or more cycles during one or more revolutions of the engine. By controlling the number of cycles in which the pump is operative, it is possible to control the actual amount of lubricant supplied. If such a pump becomes inoperative or the components stick, however, then dangerous conditions can occur for the engine.

Another problem with these reciprocating type pumps, which are normally electrically operated, is that the circuitry and associated control mechanisms greatly complicate the lubricant system. In addition, the extra components necessary takes up space which, in applications such as outboard motors, may not be available.

It is an object of this invention to provide a lubricant pump and pump control for a lubricant supply system of an engine overcoming the above-stated problems.

SUMMARY OF THE INVENTION

In accordance with the present invention, there is provided an improved lubricant supply system for providing lubricant from a lubricant supply to one or more portions of an internal combustion engine.

The system includes a lubricant pump and a pump control. Preferably, the pump comprises a housing in which is positioned a solenoid-operated pumping element and at least a portion of the pump control.

In a preferred embodiment of the present invention, means are provided for detecting an abnormal condition of the pump and for providing a warning and/or stopping the engine in the event of an abnormal condition.

The lubricant supply system of the present invention is adapted to provide lubricant to the engine based on the actual operating needs of the engine. In addition, the system is arranged so that the pump occupies little space and does not unduly complicate the lubricant system or related circuitry.

Further objects, features, and advantages of the present invention over the prior art will become apparent from the detailed description of the drawings which follows, when considered with the attached figures.

DETAILED DESCRIPTION OF THE PREFERRED EMBODIMENTS OF THE INVENTION

Figure 1:
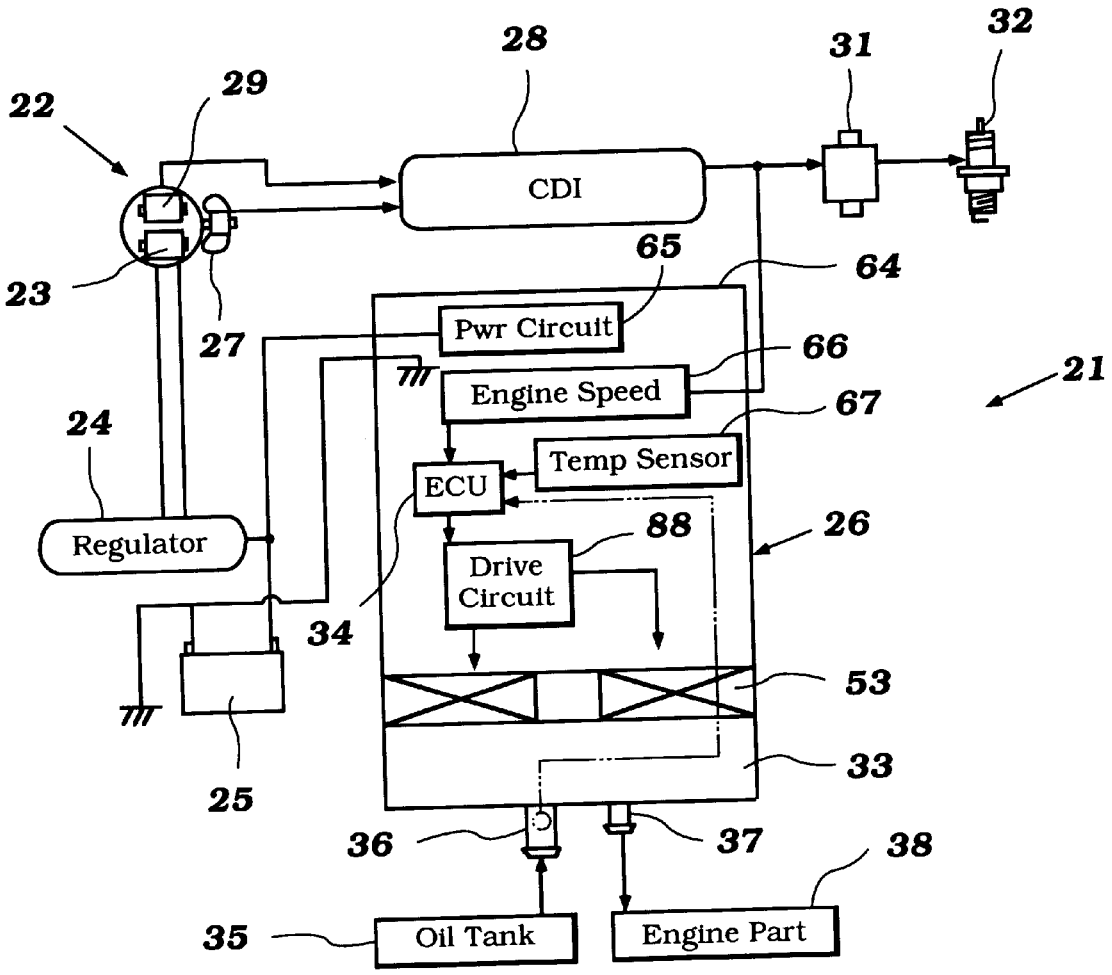
FIG. 1 is a partially schematic view of an internal combustion engine having a lubricant supply system in accordance with the present invention and showing some of the control components and associated systems.

Referring now in detail to the drawings and initially primarily to FIG. 1, certain components of an internal combustion engine, which is identified generally by the reference numeral 21, are illustrated. In this figure, the actual construction of the basic engine 21 is not illustrated because it will be readily apparent to those skilled in the art how the invention can be utilized with a wide variety of engine types and configurations. However, the invention has particular utility in conjunction with two cycle engines wherein the engine is lubricated by delivering finite amounts of lubricant to certain components of the engine.

For example and as is well-known in the art, oil or other lubricant may be delivered in incremental amounts to the skirt of the piston through, for example, a lubricating orifice in the cylinder bore, and to the various journal surfaces associated with the crankshaft, connecting rod, and the connection of the connecting rod to the piston through the piston pin. Since these specific delivery systems are not a significant part of the invention and since the invention deals primarily with the monitoring of the output of the lubricating pump, the engine details are not illustrated.

Basically, the engine has an output shaft that is coupled to a load and which drives a magneto generator assembly, shown schematically by the reference numeral 22. This magneto generator system 22 includes a charging coil 23 which is associated with one or more magnets driven by the flywheel for generating electrical power output. This output is delivered to a regulator 24 for charging a battery 25.

In addition, the battery output is employed to a control and pump unit, indicated generally by the reference numeral 26 and which will be described in more detail later.

A pulser coil 27 is associated with the magneto generator 22 and outputs a trigger circuit to a CDI ignition unit, shown schematically and identified by the reference numeral 28. This CDI unit includes a capacitor (not shown) charged by a further charging coil 29 which, when discharged will induce a voltage in a coil 31. This voltage is stepped up and is utilized to fire a spark plug 32.

As should be readily apparent, the spark plug 32 is associated with the combustion chamber of the engine for igniting a charge in the combustion chamber. This type of arrangement is well known in the art and, for that reason, a detailed description of it is not believed to be necessary to permit those skilled in the art to practice the invention for the reasons which have been aforenoted.

Continuing to refer to FIG. 1, the control and pump unit 26 includes as a subcomponent an oil pump which is shown schematically and as identified by the reference numeral 33. This oil pump 33 may be of the type shown in FIGS. 2 or 5 and will be described in more detail later by reference to them.

This oil pump 33 is operated by an electronic control unit (ECU) 34 which preferably includes a CPU through a control circuit and in accordance with a control strategy which are described later. Basically, the oil pump 33 functions so as to draw oil from an oil reservoir or tank 35 through an inlet check valve 36. During each stroke of the oil pump 33, a finite amount of lubricant is delivered through a discharge port 37 to the engine components, one of which is illustrated schematically and identified by the reference numeral 38. It is to be understood that there may be one or more discharge conduits that supply various components of the engine. As has been noted, these types of systems are well known in the art and the invention may be utilized with most known systems.

Figure 2:
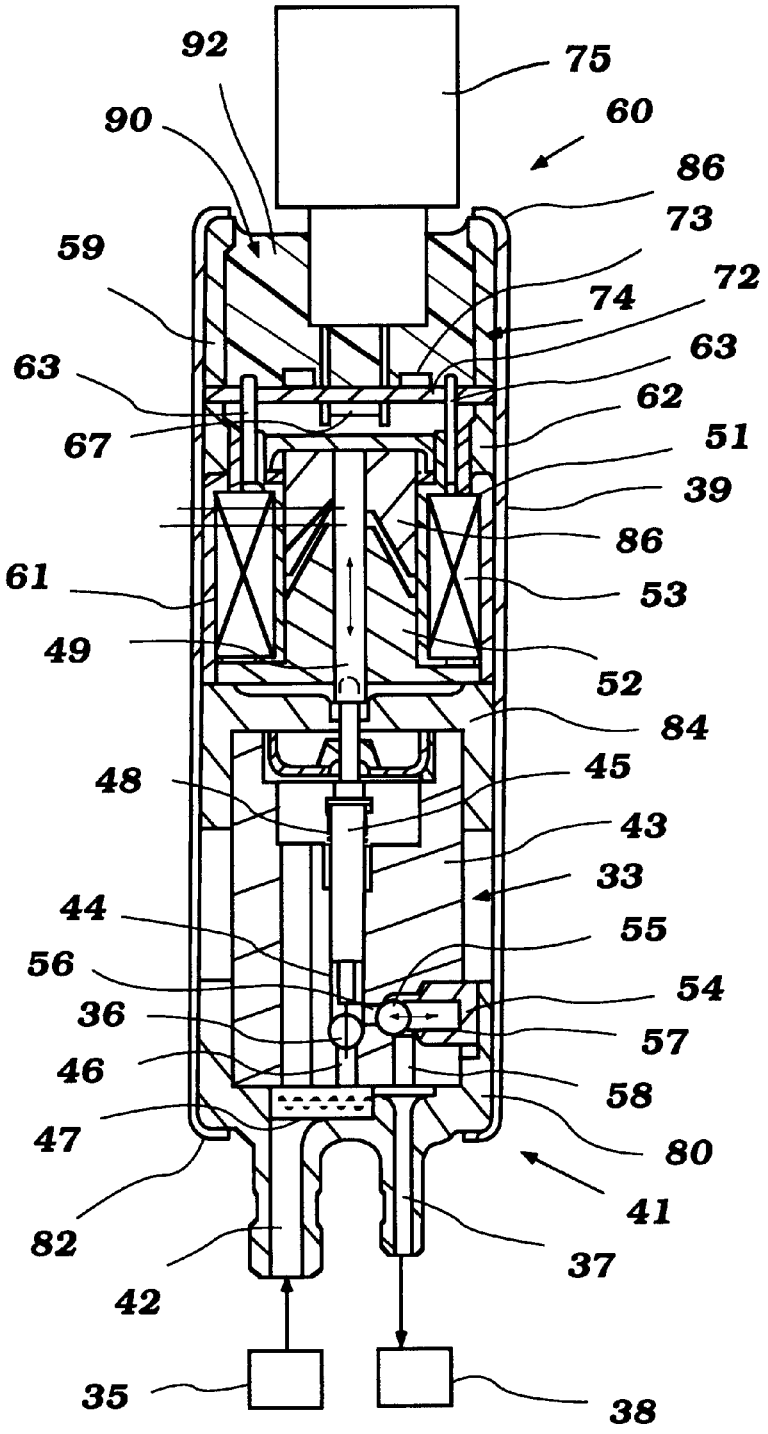
FIG. 2 is an enlarged cross-sectional view showing a lubricant pump and a first sensor arrangement associated therewith for use in the system illustrated in FIG. 1.
Figure 3:
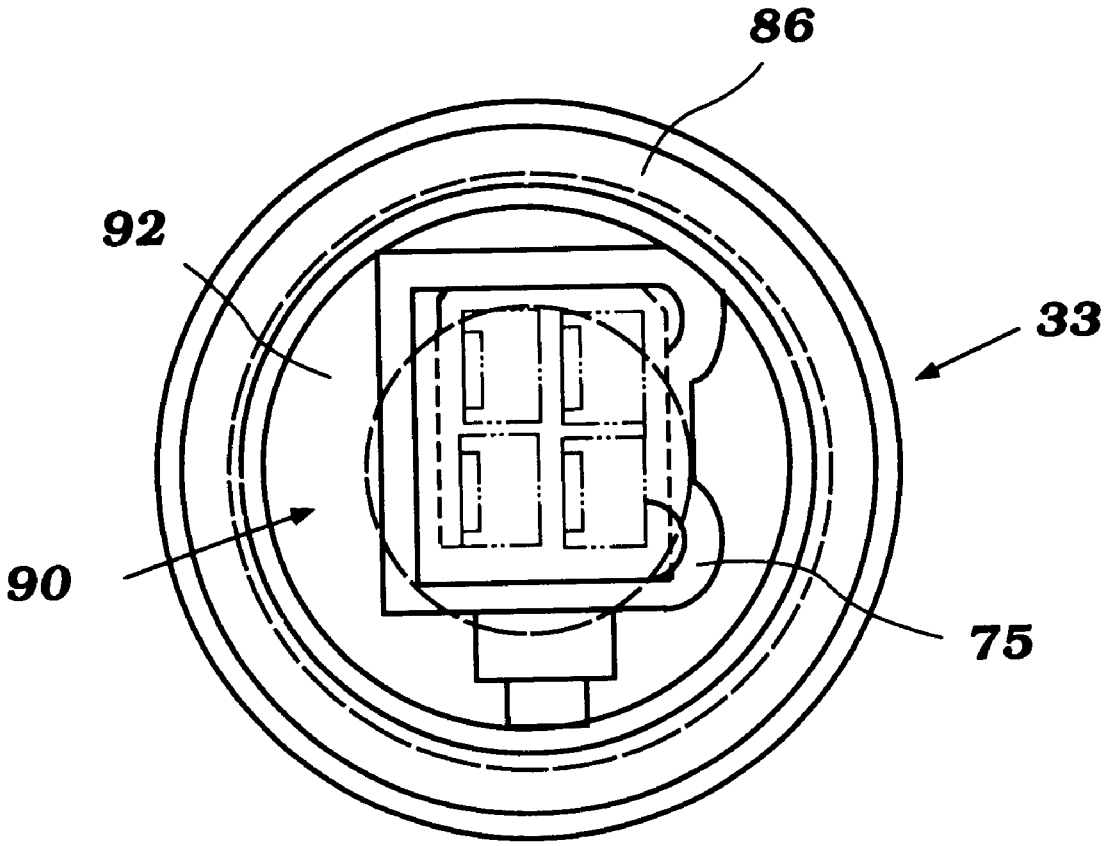
FIG. 3 is a top view of the pump and sensor illustrated in FIG. 2.
Figure 4:
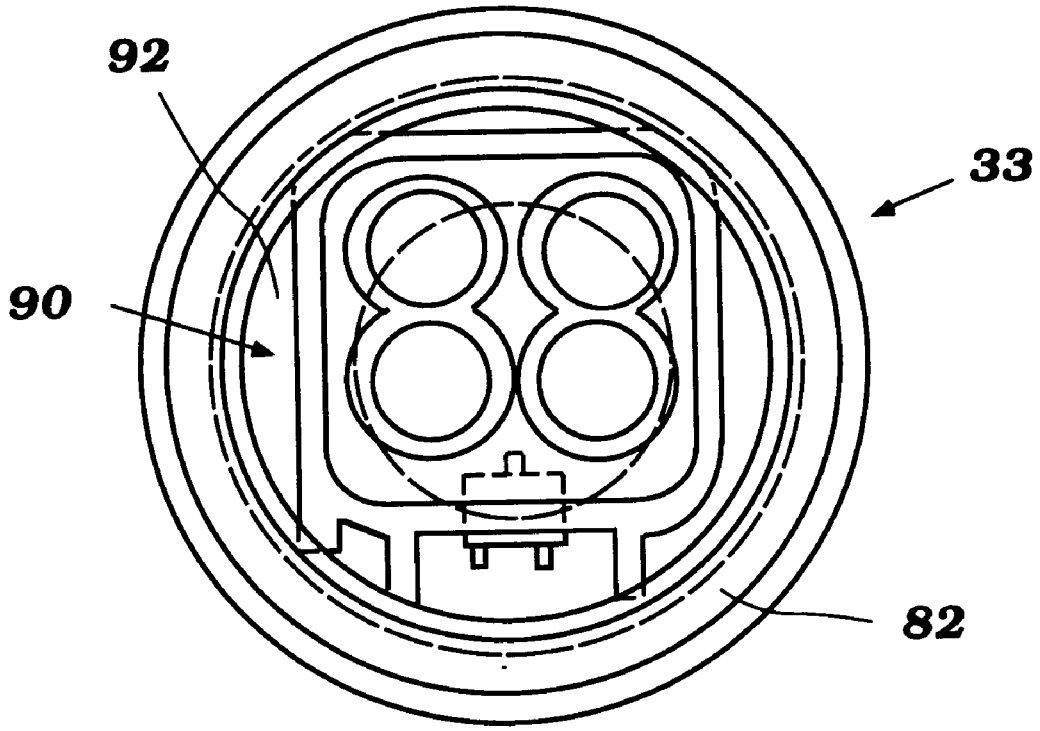
FIG. 4 is a bottom view of the pump and sensor illustrated in FIG. 2.

A first embodiment lubricant or oil pump 33 will now be described in more detail by reference to FIGS. 2–4. This oil pump 33 includes a housing that consists of an outer shell 39, a multi-part casing provided in the shell 39, a pump body 43, a pump drive mechanism 74, at least a portion of the pump control, and preferably one or more sensors.

A first casing portion 80 is provided at a bottom or first end 41 of the pump 33. The shell 39 preferably comprises a cylindrical metal member, constructed from metal pipe or the like. The portion 82 of the shell 39 at the first end 41 of the pump 33 is crimped or bent radially inwardly to engage the first casing portion 80 and maintain the casing portion 80 within the shell 39.

The first casing portion 80 defines a discharge conduit 37 and an inlet conduit 41 having a passageway 42. The pump body 43 is mounted within the first casing portion 80 and a second casing portion 84 positioned within the shell 39. The pump body 43 includes a pumping bore 44 in which a pumping plunger 45 is reciprocally supported.

This pumping bore 44 communicates with the conduit 42 through a supply passage 46 in which a filter element 47 is positioned. The delivery check valve 36 is provided internally of this unit. It is to be understood, however, that there may be a series of delivery check valves.

Figure 5:
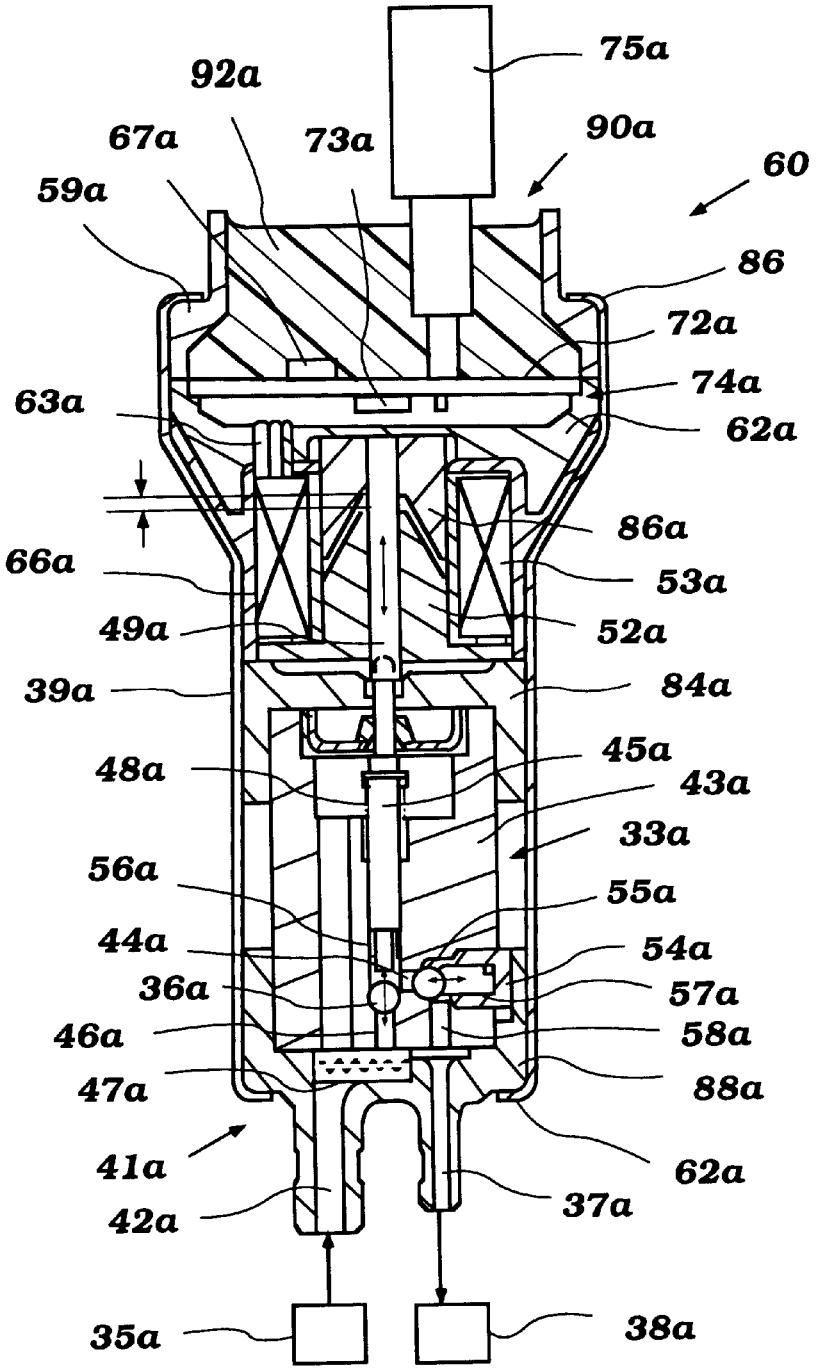
FIG. 5 is a cross-sectional view, in part similar to FIG. 2, and illustrating another pump with a sensor in accordance with a second embodiment of the present invention.

A drive 74 is provided for moving the plunger 45 of the pump 43 for pumping lubricant at a desired time. Preferably, the plunger 45 is normally urged to a retracted position as shown in FIGS. 2 and 5 by a coil compression spring 48. When this occurs, the effective volume of the pumping bore 44 increases and fluid will be drawn through the conduit 42, filter 47 and passage 48 to open the delivery valve 36 and permit filling of the chamber.

The upper end of the pumping plunger 45 is connected to a slider 86 associated with an armature 49 of a solenoid assembly, indicated generally by the reference numeral 51. This solenoid assembly 51 includes a core 52 in which the armature 49 reciprocates. A solenoid winding or coil 53 encircles the core 52 and when energized will effect reciprocation of the armature 49 and, accordingly, reciprocation of the pumping plunger 45.

Basically, when the winding 53 is energized, the armature 49 moves downwardly and force the pumping plunger 45 in the same direction to compress the spring 48. Fluid is then expelled through a discharge fitting that is comprised of a check valve assembly 54 having a ball-type check valve 55 that controls the flow from the pumping chamber 44 through a discharge passage 58. When the check valve 55 opens, against the action of a spring 57, communication with a passage 58 in the pump body 43 permits flow to the discharge conduit 37.

To continue to describe the pump 33 construction, the pump includes a top or upper end 60. A third casing section 59 is provided in the shell 39 at the top end 60. This casing section 59 defines an interior area. A crimped or radially inwardly extending portion 86 of the shell 39 at the top end 60 of the pump 33 maintains the third casing section 59 within the shell 39.

Positioned below the third casing member 59 is a generally annular spacer element 62. A solenoid retainer member 61 is positioned between the spacer element 62 and the second casing member 84 therebelow. Terminals for the winding 53, indicated at 63, pass through the spacer element 62.

Referring again to FIG. 1, a drive circuit for the winding or coil 53 is shown schematically at 88. The drive circuit 88 receives the output of the ECU 34 and effects energization or deenergization of the winding 53 so as to effect the pump operation.

The pump 33 is operated through a pumping cycle in a given time period which is determined in a manner to be described so as to ensure that adequate amounts of lubricant are supplied to the engine components 38.

In order to accomplish this, a control unit, indicated generally by the reference numeral 64, includes a power circuit 65 that receives electrical power from either the battery 25 or regulated power from the magneto generator charging coil 23. This is utilized to control the pump 33 by switching of the electrical power to the solenoid winding 53 through the drive circuit 63.

Certain engine data is supplied to the ECU 34 for this control. This includes an engine speed signal that is provided by a sensor unit 66 in the control 64. This sensor 66 receives pulses from the CDI unit 28 that are transmitted to the coil 31 and hence provide an indication of number of firings of the spark plug 32 in a given time period. This provides an engine speed signal, as should be readily apparent.

In addition, a temperature detector 67 may be incorporated so as to sense the oil temperature and control the amount of lubricant based upon this.

In accordance with the present invention, there is also provided a pump condition or abnormal condition detector indicated generally by the reference numeral 73 and which operates in a manner which will be described. In the event of an abnormal condition this operational detector 73 outputs a signal to an abnormal state detector circuit of the ECU which operates in accordance with a strategy which will be described.

Referring again to FIG. 2, the pump 33 thus includes a temperature detector 67 and an abnormal condition sensor 73. Besides the sensor portions of the pump control, a circuit board 72 is positioned within the pump 43 and maintained in position between the third casing section 59 and the spacer element 62.

The abnormal condition sensor 73 preferably comprises a sensor for determining when there is a magnetic field generated as a result of the energization of the coil 53. This information is collected and then sent to the ECU 34 through a conductor 75. The sensor 73 provides a signal indicative of the time when a current is actually flowing through the winding 53 and, accordingly, the pump plunger 45 is being driven. This signal is then compared by a comparator with an actual driving signal from the ECU 34 and, if there is a dissimilarity, determined in a manner described below, then either a warning and/or protective action may be initiated.

The temperature sensor 67 is similarly linked to the conductor 75 for transmitting temperature data to the ECU 34 as illustrated in FIG. 1.

Preferably, the conductor 75 is positioned in the space defined by the third casing member 59. A waterproof coupling 90 is provided between the sensors 67,73 and the conductor 75 and the conductor and ECU 34, in that a resin 92 or similar waterproofing material fills in the space within the third casing segment 59 around these elements.

FIG. 5 illustrates a second embodiment pump 33*a*. This embodiment pump 33*a* is similar to that illustrated in FIGS. 2–4 and described above, and as such, like reference numerals have been given to similar parts, except that an "a" designator has been added thereto.

This embodiment the pump 33 also includes the mounting plate 72*a,* temperature detector 67*a,* abnormal condition sensor 73*a,* and connector 75*a*. In this embodiment, the abnormal condition sensor 73*a* comprises a proximity sensor which senses when the armature 49*a* and slider 86*a* are in proximity to it and, hence, by measuring when the signal disappears and returns, it is possible to measure the actual movement of the pump plunger 45*a* through its pumping cycle. This sensor 73*a* has the benefit that it will sense pump failures that the sensor 73 described above will not. For example, if the plunger 45*a* seizes but the winding 53*a* is still energized, the sensor 73 of the first embodiment will not detect a failure of the pump, while the sensor 73*a* of this embodiment will.

Figure 6:
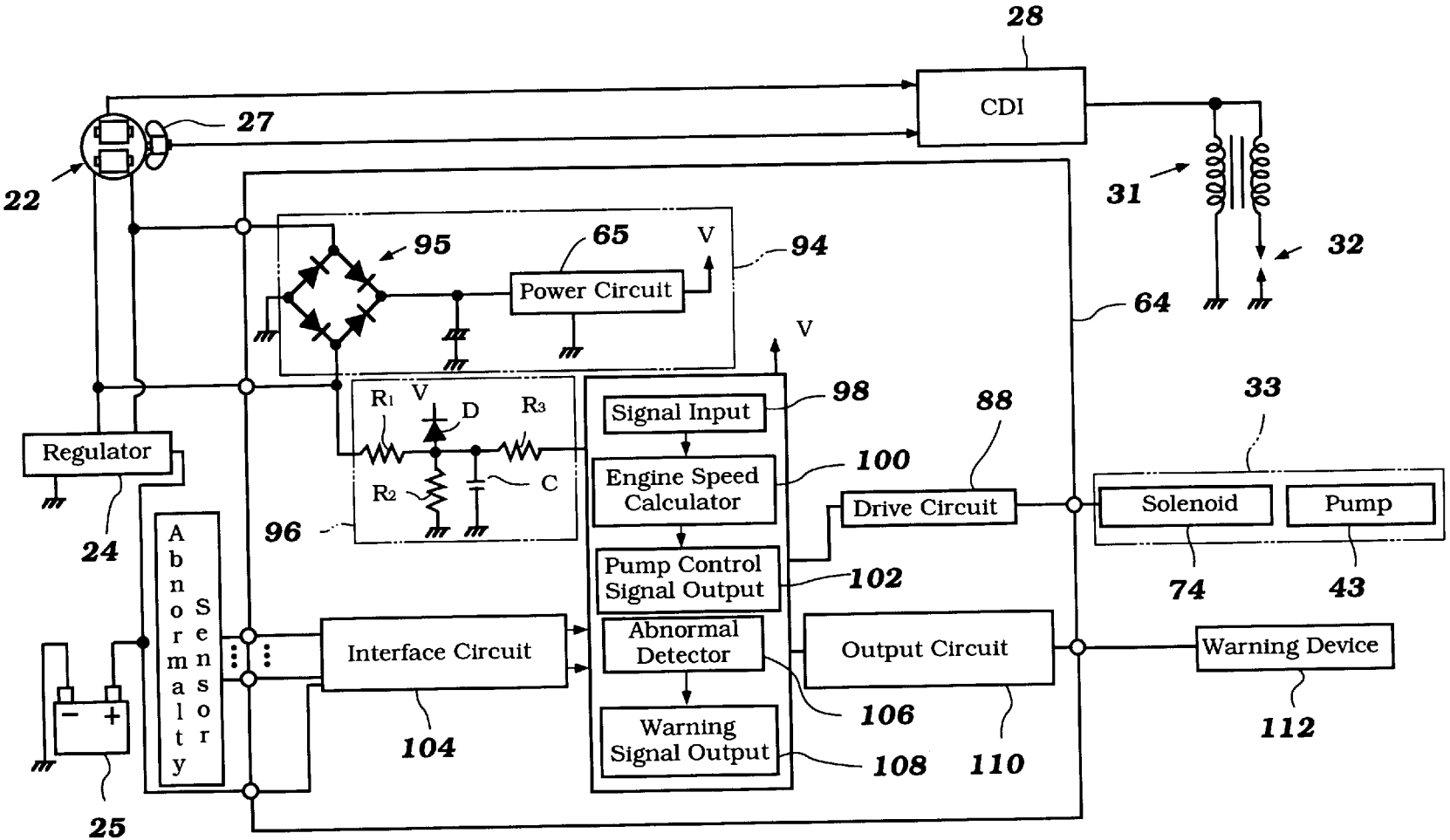
FIG. 6 is a schematic illustrating a control for the lubricant supply system in accordance with the present invention including a lubricant supply pump.

FIG. 6 illustrates, in detail, an entire control circuit or system incorporating the control unit 64. The operation of this system, including a description of how the oil pump 33 is operated and how the temperature sensor and abnormal condition sensor data is utilized will now be described in conjunction with this Figure.

As illustrated, a power system 94 is powered by the generator system 24 of battery 25. The power circuit 94 includes a rectifier 95 and the power circuit 65. The rectifier 95 is used to rectify an alternating current generated by the generator system 24 into a direct current. The power supplied to the power circuit 65 is then used to power (indicated as voltage "V") various systems of the engine.

As also illustrated in FIG. 1, the ECU 34 controls a drive circuit 88 for selectively powering the pump 33 to provide lubricant to the engine as needed. The ECU 34 is preferably powered by the power circuit 65 through a power source. The ECU 34 receives inputs from various sensors to determine the instantaneous lubricant requirements for the engine 21. Preferably, this includes the engine speed. In addition, other conditions are such as oil temperature as indicated by the detector 67 may be utilized. Load may also be read by such factors as throttle valve setting and various other parameters may be utilized. Since the specific way in which the amount of lubricant supplied forms no major part of the invention, it will not be described in any significant detail.

The engine speed is preferably determined by utilizing one of the signals generated by the generator system 22 and passing this signal through a wave-shaping circuit 96. The wave-shaping circuit 96 includes resistors R1, R2 and R3, capacitor C and diode D arranged as indicated to shape the power signal generated by the generator system 22 into a form from which the engine speed may be calculated, as is well known in the art. The shaped signal is directed to a signal input 98 and then an engine speed calculator 100. The calculator 100 preferably determines engine speed by counting wave-form pulses and then dividing the pulses over time to produce engine speed.

This engine speed data is used by the ECU 34 to determines the amount of lubricant which is being consumed by the engine based upon its instantaneous running conditions. Based upon these conditions, the ECU 34 instructs an pump control circuit 102 to power provide a signal to the drive circuit 88. The drive circuit 88, in turn, powers the solenoid of the pump driver 74, thus starting a lubricant discharge cycle of the pump 33. This is done by actuating the solenoid winding 53 so as to draw the armature 49 downwardly and drive the pumping plunger 45 through a pumping cycle. The solenoid winding is then deenergized and the pumping plunger 45 returns to its home position drawing into the chamber 44 another charge of oil.

As stated above, the lubricant supply system in accordance with the present invention also includes a warning system for warning the operator of the engine 21 that the lubricant pump 33 has malfunctioned. As illustrated, the abnormality sensor 73 (or 73*a* in the embodiment pump illustrated in FIG. 5) provides a signal to an interface circuit 104. The interface circuit 104 interfaces with the ECU 34. A detector 106 monitors the signal from the sensor 73. In the event a signal indicating an abnormality is sensed, the sensor 73 triggers a warning signal output device 108. This device sends a signal to an output circuit 110. This output circuit 110 then powers a warning device 112, such as a warning light, audible alarm or the like.

Figure 7:
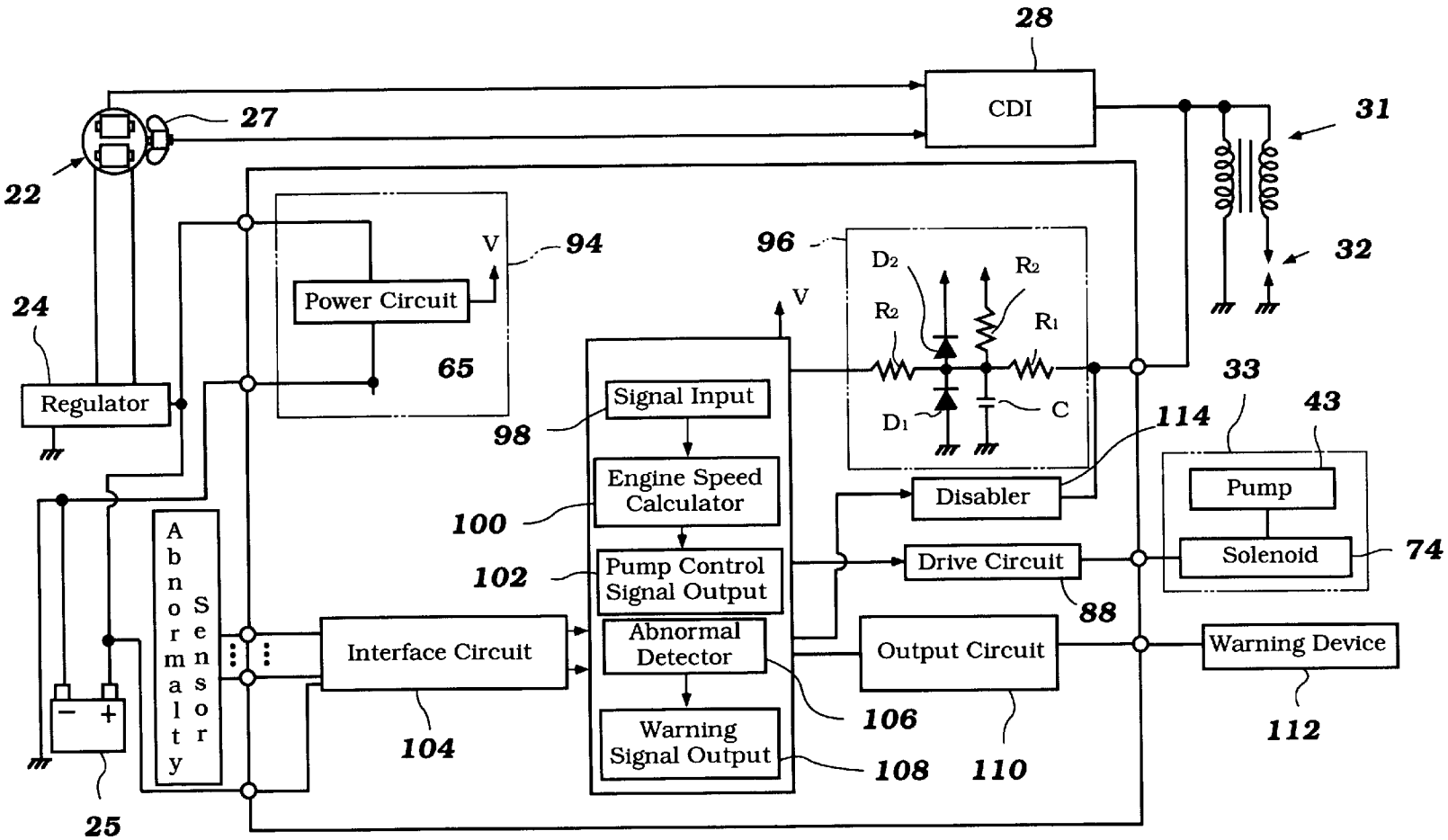
FIG. 7 is a schematic illustrating a second embodiment control in accordance with the present invention.

Another circuit arrangement including the pump control of the present invention is provided in FIG. 7. This embodiment is very similar to that illustrated in FIG. 6, and as such like reference numerals have been used with similar parts.

This arrangement varies from that illustrated in FIG. 6 mainly in that in the event an abnormality of the pump 33 is detected, the warning signal output circuit 108 provides a signal to both an output circuit 110 for powering a warning device 112, and also activates a disabler 114. The disabler 114 is arranged to ground the main power circuit providing power to the spark-ignition coil 31, thus preventing firing of the spark plug 32 and stopping the engine 21.

In accordance with the present invention, a lubricant supply system is provided which controls the amount of lubricant supplied to the engine based on the lubricant supply needs of the engine. A pump 33 of the supply system is arranged such that a housing 39 encloses a pump element 43 and a portion of the pump control, whereby a compact pump arrangement is provided.

It will be understood that the above described arrangements of apparatus and the method therefrom are merely illustrative of applications of the principles of this invention and many other embodiments and modifications may be made without departing from the spirit and scope of the invention as defined in the claims.

We claim:

1. A pump for a lubricant supply system for an internal combustion engine, said lubricant system supplying lubricant from a lubricant supply source to at least one portion of the engine, said lubricant pump being comprised of an open ended tubular outer housing, a first end closure received in and closing one end of said tubular outer housing, said first end closure having inlet and outlet fittings extending through said one end of said tubular housing, said inlet fitting being adapted to directly receive a supply conduit communicating with the lubricant supply source, said outlet fitting being adapted to directly receive a delivery conduit for delivering lubricant to the one portion of the engine, said first end closure defining a cavity receiving and supporting one end of a pumping body defining a pumping chamber receiving a reciprocating pumping element, said pumping body further defining passages communicating said pumping chamber with said inlet and said outlet fittings, an intermediate housing member received generally centrally of said tubular outer housing, said intermediate housing member defining a cavity receiving and supporting the other end of said pumping body, said pumping element having an end portion extending through said intermediate housing member, a solenoid for operating said reciprocating pumping element supported upon said intermediate housing member on the side thereof opposite to said pumping body and cooperating with said pumping element end portion for effecting reciprocation of said reciprocating pumping element, and a control received in the other end of said tubular outer housing for controlling the reciprocation of said pumping element by activating said solenoid so as to control the amount of lubricant delivered to said engine, and a second end closure received in and closing the other end of said tubular outer housing and retaining said solenoid therein.

2. A lubricant supply system for an internal combustion engine in accordance with claim 1, wherein said tubular outer housing ends curve radially inwardly for retaining said pumping element and control therein.

3. A lubricant supply system for an internal combustion engine in accordance with claim 1, wherein said control includes a circuit board positioned within said tubular outer housing.

4. A lubricant supply system for an internal combustion engine in accordance with claim 1, wherein said control further includes means for detecting an abnormal condition of said pump positioned within said tubular outer housing.

5. A lubricant supply system for an internal combustion engine in accordance with claim 2, including means for activating a warning in the event an abnormal condition is detected.

6. A lubricant supply system for an internal combustion engine in accordance with claim 1, wherein said control further including means for detecting a temperature of said pump positioned within said tubular outer housing.

7. A lubricant supply system for an internal combustion engine in accordance with claim 1, wherein said control includes means for detecting a speed of the engine and for activating said pump based on said speed of said engine.

8. A lubricant supply system for an internal combustion engine in accordance with claim 1, wherein said solenoid is positioned below a circuit board, and a conductor transmitting information to a control member mounted to said circuit board on an opposite side of said solenoid.

9. A lubricant supply system for an internal combustion engine in accordance with claim 8, wherein resin surrounds said connector and its connection to said circuit board.

10. A lubricant supply system for an internal combustion engine in accordance with claim 1, wherein said control includes a power source, means for detecting a speed of the engine, and means for activating said solenoid based upon said engine speed.

11. A lubricant supply system for an internal combustion engine in accordance with claim 10, further including means for disabling said means for activating said solenoid in the event of a malfunction of said pumping element.

* * * * *